US006553800B2

(12) United States Patent
Doerr et al.

(10) Patent No.: US 6,553,800 B2
(45) **Date of Patent: *Apr. 29, 2003**

(54) SIDE BAR PLUNGER AND SOLENOID CYLINDER LOCKING MECHANISM

(75) Inventors: Alan Doerr, Tomball, TX (US); Pete Kajuch, Brookfield, WI (US); Cheryl Kay Koskela, Santa Rosa, CA (US)

(73) Assignee: Schlage Lock Company, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/766,019

(22) Filed: Jan. 19, 2001

(65) Prior Publication Data

US 2001/0023602 A1 Sep. 27, 2001

Related U.S. Application Data

(60) Provisional application No. 60/176,997, filed on Jan. 19, 2000.

(51) Int. Cl.[7] ..... E05B 47/06

(52) U.S. Cl. ..... 70/278.3; 70/278.7; 70/283.1; 70/495

(58) Field of Search ..... 70/278.2, 278.3, 70/283.1, 278.7, 495, 277, 279.1, 283

(56) References Cited

U.S. PATENT DOCUMENTS

| | | | | | |
|---|---|---|---|---|---|
| 4,312,198 | A | | 1/1982 | Sedley | 70/276 |
| 4,366,688 | A | | 1/1983 | Bennett | 70/395 |
| 4,440,011 | A | | 4/1984 | Klein | 70/438 |
| 4,562,712 | A | | 1/1986 | Wolter | 70/456 R |
| 4,663,952 | A | | 5/1987 | Gelhard | 70/408 X |
| 4,789,859 | A | * | 12/1988 | Clarkson et al. | 70/278.3 X |
| 4,848,115 | A | * | 7/1989 | Clarkson et al. | 70/278.2 X |
| 4,868,409 | A | | 9/1989 | Tanaka et al. | 307/10.5 |
| 5,003,801 | A | | 4/1991 | Stinar et al. | 70/408 X |
| 5,010,750 | A | | 4/1991 | Böser et al. | 70/276 |
| 5,091,771 | A | | 2/1992 | Bolan et al. | 357/74 |
| 5,111,007 | A | * | 5/1992 | Miller et al. | 70/432 X |
| 5,156,032 | A | | 10/1992 | Edgar | 70/413 X |
| 5,255,547 | A | | 10/1993 | Burr et al. | 70/252 |
| 5,281,945 | A | | 1/1994 | Keppner et al. | 70/413 X |
| 5,311,757 | A | | 5/1994 | Spahn | 70/408 |
| 5,337,588 | A | * | 8/1994 | Chhatwal | 70/278.3 |
| 5,367,295 | A | | 11/1994 | Gokcebay et al. | 235/382 X |
| 5,433,096 | A | | 7/1995 | Janssen et al. | 70/395 X |
| 5,435,160 | A | | 7/1995 | Linsalato et al. | 70/408 |
| 5,437,174 | A | | 8/1995 | Aydin | 70/280 X |
| 5,507,162 | A | * | 4/1996 | Chhatwal | 70/283 X |
| 5,541,581 | A | | 7/1996 | Trent | 70/283 X |
| 5,542,274 | A | * | 8/1996 | Thordmark et al. | 70/277 X |
| 5,552,777 | A | * | 9/1996 | Gokcebay et al. | 70/278.3 X |
| 5,689,985 | A | | 11/1997 | Chamberlain | 70/438 |
| 5,826,450 | A | * | 10/1998 | Lerchner et al. | 70/283 X |
| 6,227,020 | B1 | * | 5/2001 | Lerchner | 70/278.3 |
| 6,374,653 | B1 | * | 4/2002 | Gokcebay et al. | 70/278.3 |
| 6,442,986 | B1 | * | 9/2002 | Russell et al. | 70/278.3 |

FOREIGN PATENT DOCUMENTS

| | | | | |
|---|---|---|---|---|
| DE | 41 41 270 A 1 | | 6/1993 | |
| FR | 2518618 | * | 6/1983 | 70/278.2 |
| GB | 2 039 321 A | | 8/1980 | |
| GB | 2 263 302 A | | 7/1993 | |

* cited by examiner

*Primary Examiner*—Lloyd A. Gall
(74) *Attorney, Agent, or Firm*—Michael Best & Friedrich LLP

(57) ABSTRACT

The present invention is directed at an electronic lock assembly which uses a simplified locking mechanism, which is operable by a suitably programmed electronic key. The invention is directed to a cylinder type locking mechanism wherein a solenoid and plunger is provided to electronically lock and unlock a key cylinder, thereby allowing rotation of the key cylinder for unlocking of a locking mechanism when a suitably programmed electronic key is used in connection with the mechanism. A side bar and retaining spring engage the cylinder plug to prevent rotation thereof in the locked position with the side bar contacted by the plunger of the solenoid to prevent the side bar from moving until an authorized key is used to unlock the mechanism.

15 Claims, 5 Drawing Sheets

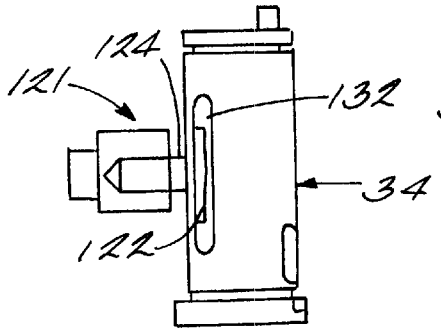
Fig. 9
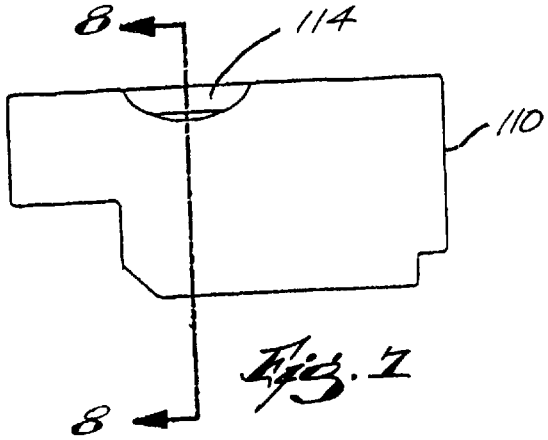
Fig. 7
Fig. 8
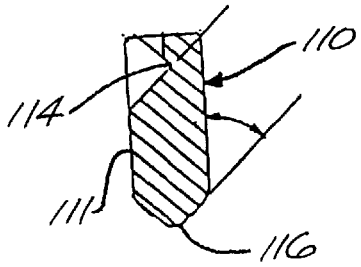
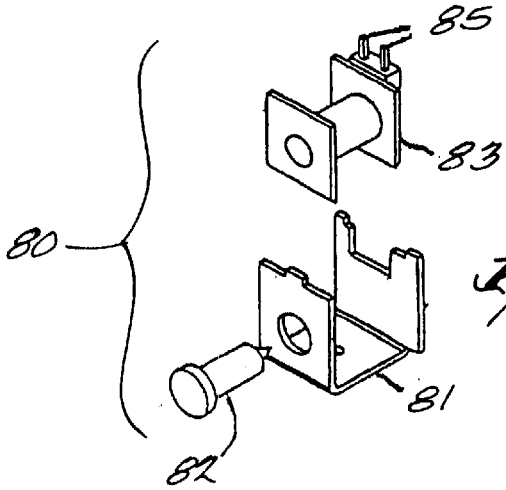
Fig. 6

SIDE BAR PLUNGER AND SOLENOID CYLINDER LOCKING MECHANISM

This invention relates to an electronic lock assembly having a side bar plunger and solenoid cylinder locking mechanism. This application claims the benefit of U.S. Provisional Application No. 60/176,997 filed Jan. 19, 2000, herein incorporated by reference.

TECHNICAL FIELD

BACKGROUND OF THE INVENTION

In many environments, such as apartment houses, multi-family dwellings, condominiums or the like, the transient nature of residents present problems in using conventional locking mechanisms in association with a door having a latch which is operable from both sides of the door by means of a handle or the like. In such environments, keys usable to unlock conventional lockable latching mechanisms are easily replicated, thereby potentially compromising the security provided by the lockable latching mechanism. As tenants or occupants move from such an environment, a key or copy of the key can be retained, though the former tenant or occupant is no longer entitled to access thereto. Similarly, if maintenance or repair procedures require access by other personnel, maintaining security may again be compromised if keys are duplicated or not returned by the repair or maintenance personnel. Thus, security standards in such environments may require that the lock be removed in its entirety and replaced, or the lockable latching mechanism is swapped with another mechanism from another unit to ensure security. Another alternative is to have the lockable latching mechanism re-keyed such that the previous key will not operate the mechanism. In each of these situations, the replacement, re-keying or swapping of the lockable latching mechanism is costly, both in terms of expense and/or personnel resources, and/or presents a time consuming and inefficient process for ensuring security.

Attempts have therefore been made to provide enhanced security by providing an electronic lock which employs a programmable processor which can be programmed to only allow operation of the lock if a valid key is used. Thus, when a tenant moves from a premises, the electronic lock can simply be reprogrammed so that the old key will not operate the lock, thereby eliminating the need to replace or re-key the lock. Although electronic locks using card readers, key pads or contact activated data ports are known, various deficiencies in such electronic lock assemblies have been found, and such systems have generally been cost prohibitive or complex, thereby limiting widespread use in such environments.

SUMMARY OF THE INVENTION

Based upon the foregoing, the present invention is directed at an electronic lock assembly which uses a simplified locking mechanism, which is operable by a suitably programmed electronic key. It is therefore an object of the invention to provide an electronic lock mechanism which can be manufactured simply, is reliable in use, and is cost-effective to facilitate use in suitable environments, and to avoid the need to re-key or replace existing lock mechanisms while providing enhanced security.

The invention is directed to a cylinder type locking mechanism wherein a solenoid and plunger is provided to electronically lock and unlock a key cylinder, thereby allowing rotation of the key cylinder for unlocking of a locking mechanism when a suitably programmed electronic key is used in connection with the mechanism. A side bar and retaining spring engage the cylinder plug to prevent rotation thereof in the locked position with the side bar contacted by the plunger of the solenoid to prevent the side bar from moving until an authorized key is used to unlock the mechanism.

These and other aspects of the invention will become apparent from the following detailed description of the invention when considered in conjunction with the accompanying drawings.

BRIEF DESCRIPTION OF THE DRAWINGS

FIG. 6 is an exploded view of the solenoid and plunger according to this embodiment;

FIG. 7 is a side elevational view of a sidebar according to this embodiment;

FIG. 8 is a cross sectional view taken along line 8—8 in FIG. 7; and FIG. 9 is a top elevational view of an alternate embodiment of a solenoid/cylinder locking mechanism.

DETAILED DESCRIPTION OF THE INVENTION

Figure 1:
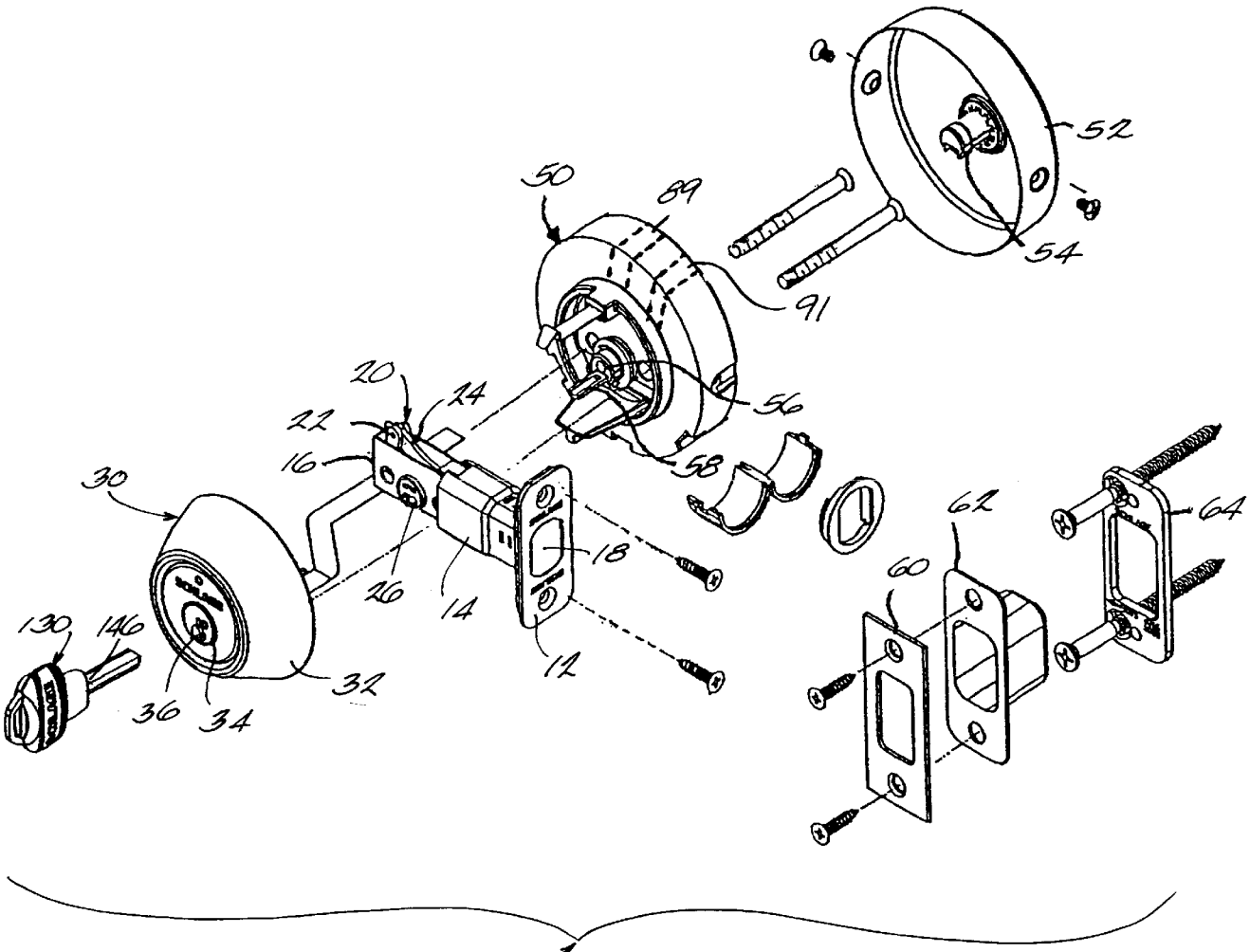
FIG. 1 is a perspective exploded schematic view showing an electronic deadbolt locking mechanism according to an embodiment of the invention.

Turning now to FIG. 1, the present invention will be described in conjunction with an electronic deadbolt assembly 10. As shown in FIG. 1, the deadbolt assembly 10 may include a face plate 12, which will normally be visible from the edge of the door. A front case 14 may be joined to the front plate 12, and a rear case 16 is provided in telescopic adjustable relationship to the front case 14. A deadbolt 18 is provided in slideable relationship within the front case 14, and is coupled to a swivel generally indicated at 20. The swivel mechanism 20 may include a pair of ears 22 connected to a link 24. The link 24 is connected to the bolt 18 in a suitable fashion, and operation of the deadbolt 18 between a fully extended position and a retracted position is provided by means of a spindle 26 in a known fashion. In general, spindle 26 is engaged between inner and outer cylinders, wherein upon rotation of the cylinders, spindle 26 rotates to cause corresponding movement of the swivel 22 and link 24 and movement of bolt 18 between extended and retracted positions. The structures of the front case 14, rear case 16 and operation of the deadbolt is typical, and details of this construction and operation may be modified in accordance with known mechanisms.

The deadbolt assembly 10 as shown in FIG. 1 further comprising an outside housing assembly 30, which includes an outside rose 32 and a lock cylinder or cylinder plug 34, which will be described in more detail hereafter. The cylinder plug 34 includes a keyway 36, into which an electronic key 130 is inserted for operation of the deadbolt assembly 10. The deadbolt assembly 10 further comprises an inside turn assembly generally designated 50, over which an inside rose 52 is positioned. A thumbturn 54 engages the inside turn assembly 50 such that operation of the thumbturn 54 will in turn cause rotation of a thumbturn extension 56 coupled to the inside turn assembly 50 having an outwardly extending portion 58 which engages spindle 26 in the deadbolt assembly. Thus, upon rotation of the thumbturn 54 on the interior of the door, rotation of the thumbturn extension 56 will in turn cause rotation of extension portion 58 so as to operate spindle 26 causing corresponding extension or retraction of the deadbolt 18 in a known fashion. The deadbolt 18 in its extended position engages a strike 60 positioned on the doorjamb, and an associated strike box 62. A strike reinforcer 64 may be provided to enhance the structural integrity and security of the deadbolt latch.

It should be recognized that operation of a thumbturn in conjunction with the inside turn assembly 50 to selectively extend or retract the deadbolt 18 is generally known, and will not be described further.

Figure 2:
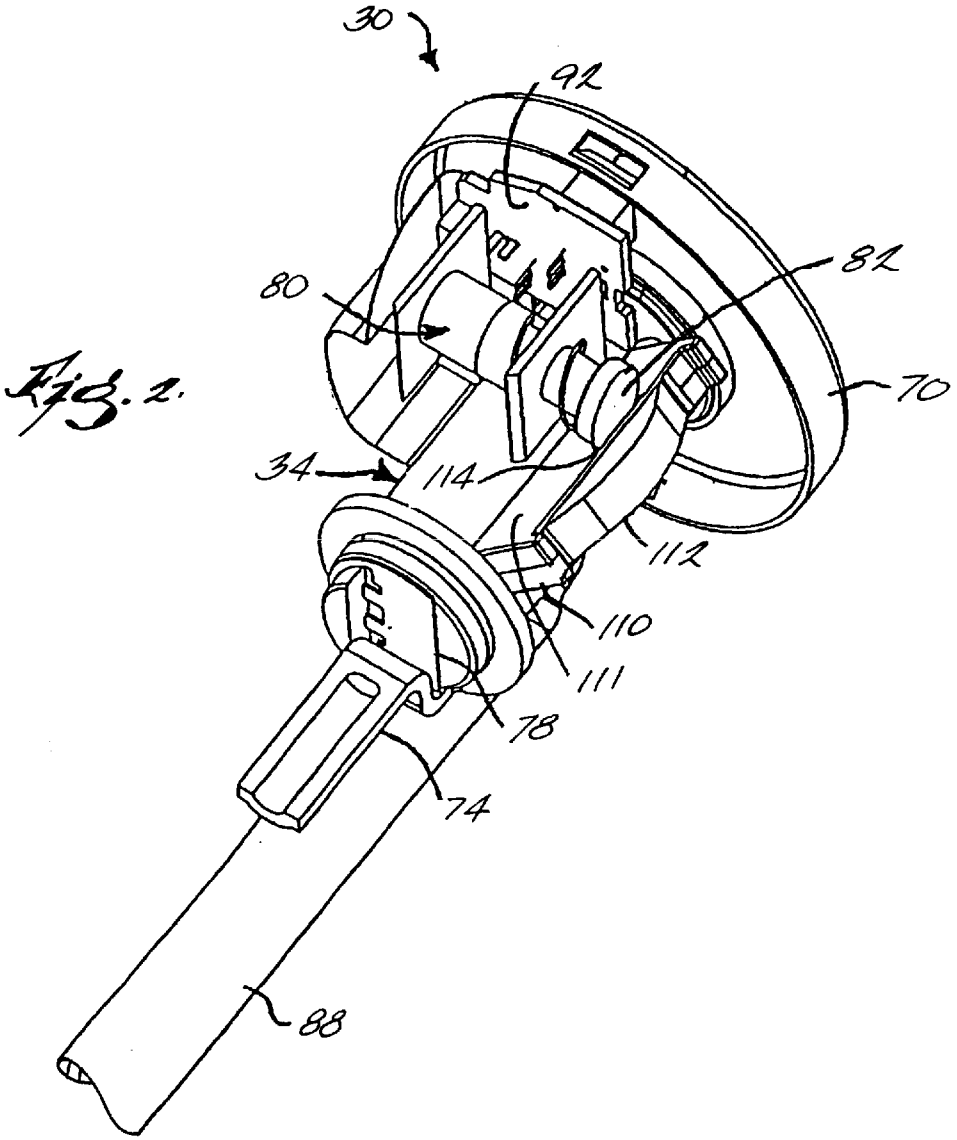
FIG. 2 is a perspective schematic view of a cylinder housing assembly.
Figure 3:
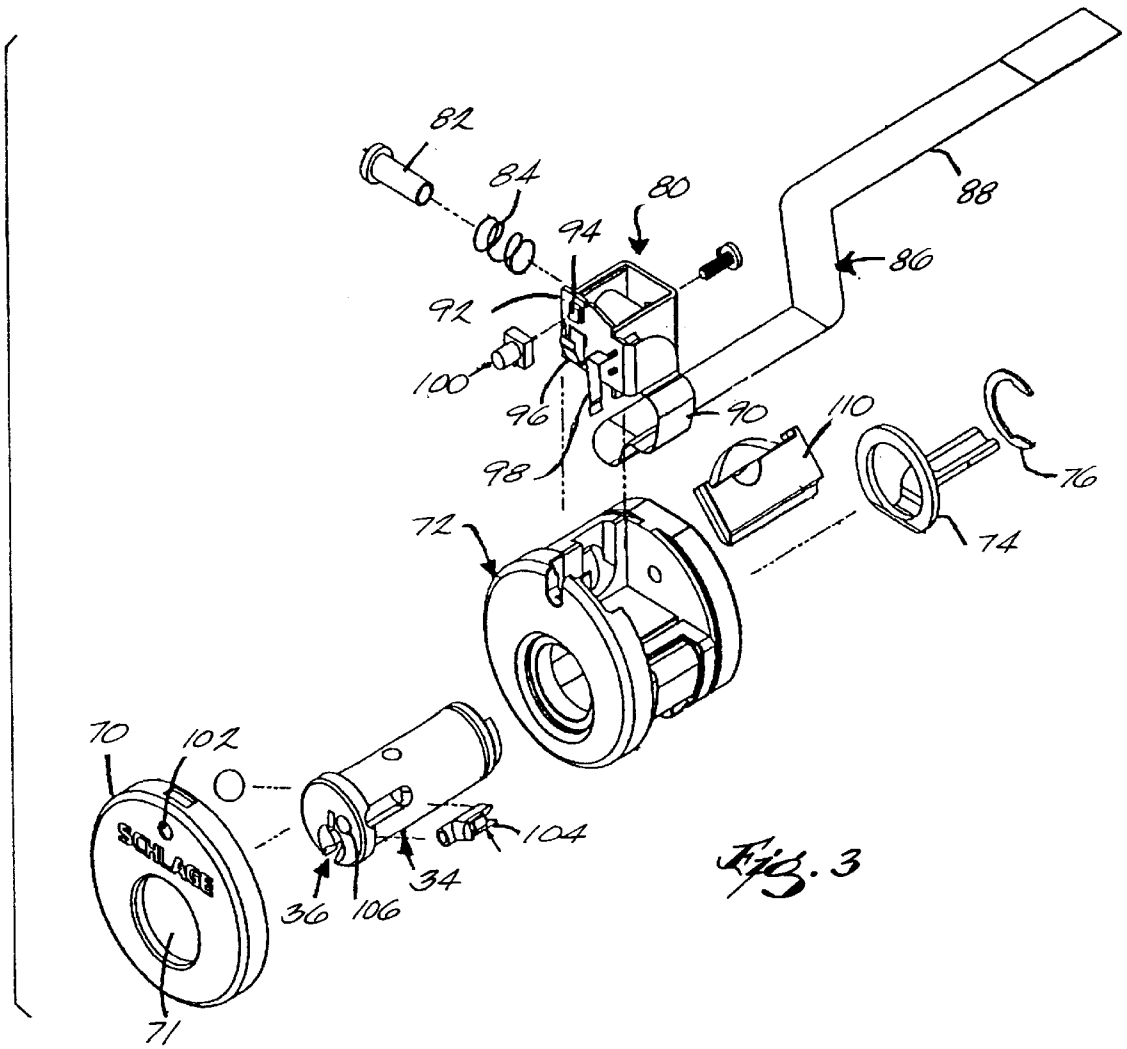
FIG. 3 is an exploded perspective view of the cylinder housing assembly as shown in FIG. 2.

Turning now to FIGS. 2 and 3, the outer housing assembly is shown in more detail. The outside housing assembly 30 includes a cylinder housing cap 70 having a hole 71 through which the cylinder plug 34 is exposed at the outside of the lock assembly. In this manner, keyway 36 will be exposed on the exterior of the lock assembly for access by an electronic key. The cylinder plug 34 is dimensioned to extend within a cylinder outside housing 72, and is selectively rotatable within cylinder outside housing 72 by means of an authorized electronic key 130 positioned within keyway 36. The electronic key 130 may include a data pin 146 extending from the front of a key housing to engage a data pin assembly 104 on the front of cylinder plug 34 as will be hereafter described in more detail. The cylinder outside housing 72 is removed from FIG. 2 for clarity of other elements situated within housing 72. After insertion of the cylinder plug 34 into housing 72, the rearward or opposing end of cylinder plug 34 disposed opposite keyway 36 engages a cylinder tailpiece 74 which is retained thereon by a retaining ring 76. The cylinder tailpiece 74 engages the spindle 26 associated with the deadbolt latch assembly as described in FIG. 1. In this manner, rotation of the cylinder plug 34 will in turn cause rotation of the spindle 26 and extends and retracts the deadbolt 18 as previously described. There also may be provided in association with the rearward end of the cylinder plug 34 a pick cap 78 which helps to prevent picking or tampering with the lock assembly.

Within the outside cylinder housing 72 is positioned a solenoid assembly generally indicated at 80, including a solenoid plunger 82 which is spring biased to an outward position by means of solenoid spring 84. As seen in FIG. 6, the solenoid assembly 80 may comprise a supporting frame 81 in association with a solenoid bobbin 83 to which electrical connection is made via pins 85. The bobbin 83 is inserted and retained therein through an opening in the frame 81. Other suitable configurations to provide solenoid assembly within the lock architecture would be recognized by those of ordinary skill, and are contemplated by the invention. Associated with the solenoid 80 is a flex assembly 86 which includes a flexible electrical connecting interface 88, which carries electrical signals to a microprocessor 89 housed within the inside turn assembly 50 as described with reference to FIG. 1. The flex assembly 86 also couples power to the solenoid 80 from a battery power source 91 housed within inside turn assembly 50 via clip (not shown) positioned at the end of flexible electrical connecting interface 88. A stiffener 92 is provided to support various components in conjunction with the flex assembly 86, including an LED 94, a ground clip 96 and a data transfer spring 98. A light pipe 100 is associated with the LED 94 to transmit light from LED 94 to the exterior of the electronic lock through an aperture 102 formed in the cylinder housing cap 70. The LED will provide information to the user, as to whether an authorized key 130 is being used (green indicating light), or whether an unauthorized key has been inserted into the electronic lock assembly (red indicating light) as an example. The LED 94 can be multi-colored to allow various light signaling indications to the user. The ground clip 96 electrically grounds the assembly to the outside cylinder housing 72 when the flex and solenoid assembly is inserted into the outside cylinder housing 72. The data transfer spring 98 extends to be electrically coupled in association with a cylinder data pin assembly 104 which is housed in association with the cylinder plug 34. The cylinder pin assembly 104 extends to a position to be accessible at the front face of the cylinder plug 34 when positioned therein, through an access hole 106. Preferably, the cylinder pin assembly 104 extends to be flush with the front face of cylinder plug 34. In operation, when an electronic key 130 is inserted into keyway 36, a contact pin 146 associated with the electronic key 130 contacts the cylinder pin assembly 104 which is in electrical wiper contact with the data transfer spring 98 to communicate data from the electronic key 130 through the flex assembly 86 to the microprocessor 89. If an authorized key 130 is used, the microprocessor 89 will in turn send a signal through the flex assembly 86 to the solenoid assembly 80 to selectively withdraw the solenoid plunger 82 against the force of bias spring 84.

Figure 4:
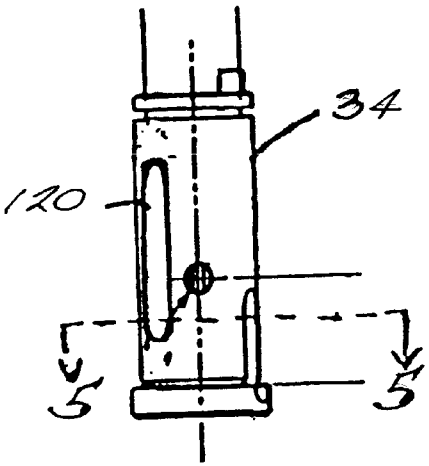
FIG. 4 is a side elevational view of the cylinder plug according to this embodiment.
Figure 5:
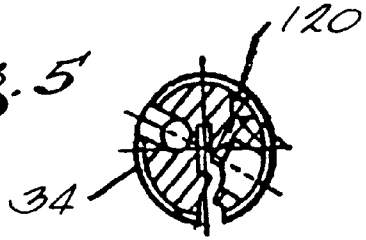
FIG. 5 is a cross sectional view taken along line 5—5 in FIG. 4.

As only an authorized electronic key 130 will provide data to initiate actuation of the solenoid by the microprocessor, rotation of the cylinder plug 34 is otherwise prevented by a rotation preventing member or sidebar 110. The sidebar 110 includes a substantially flat major face 111 extending substantially parallel to the cylinder plug 34 and a sidebar spring 112 which biases the sidebar 110 into engagement with the cylinder plug 34, to prevent rotation of the cylinder plug 34 until actuation of the solenoid and withdrawal of the plunger 82. Sidebar spring 112 may comprise one or more of many types of springs and is not limited to the leaf spring type shown. Although not shown, a pair of coil springs could also be used as the sidebar spring 112. As seen in FIGS. 4 and 5, the cylinder plug 34 includes an elongated slot 120 into which a bottom portion of the sidebar 110 is positioned. As seen in FIG. 8, the bottom portion of the sidebar comprises a contoured point 116, which is substantially matched to engage the slot 120 formed in the plug cylinder 34. As shown in FIG. 8, the contoured point 116 may be provided with angled portions, which in this embodiment are approximately 45°, to substantially match the configuration of the slot 120, which in this embodiment is formed as an approximate 90° angled slot as seen in FIG. 5. Upon attempting rotation of the cylinder plug 34, and due to the configuration of the slot 120 in association with the bottom portion 116 of the sidebar 110, the sidebar 110 will be urged outwardly from the slot 120 against bias spring 112. To prevent such movement of the sidebar 110 unless an authorized key is inserted into the cylinder plug 34, the plunger 82 of the solenoid engages the slot 114, which extends into the flat major face 111. As seen in FIG. 8, the slot 114 may also be configured to have angled sides at approximately 45°, into which the plunger 82 is positioned in its normally extended position. When the plunger 82 is positioned within the slot 114, the sidebar 110 is not able to move outwardly relative to the slot 120 formed in the cylinder plug 34. Thus, rotation of the cylinder plug 34 is prevented, thereby effectively locking the deadbolt mechanism, and not allowing retraction of the deadbolt 18 accordingly. When an authorized electronic key is inserted into the cylinder plug 34, and a data signal is generated by a microprocessor to actuate the solenoid 80, the plunger 82 is withdrawn from the slot 114 for a predetermined period of time. As a user rotates the authorized electronic key, the sidebar 110 will be urged out of the slot 120 in the cylinder plug 34 against the force of the bias spring 112, to thereby selectively allow rotation of the cylinder plug and actuation of the deadbolt mechanism to retract the deadbolt 18 and allow opening of the door. After actuation of the deadbolt mechanism by an authorized electronic key, the cylinder plug 34 is rotated back to its initial position, and the sidebar spring 112 urges sidebar 110 back into slot 120 in the cylinder plug 134 and the solenoid plunger 82 into slot 114, to thereby lock rotation of the cylinder plug at the home position until further actuation.

In this embodiment of the invention, upon insertion of an authorized electronic key 130 into the cylinder plug 34, the microprocessor 89 will withdraw the solenoid plunger from the slot 114 for a predetermined amount of time. It may be desirable to provide a short delay occurring between actuation of the solenoid and return of the plunger to its normally extended position. The microprocessor 89 may therefore be programmed to cause retraction of the plunger to accommodate a slight delay which may occur between insertion of an authorized electronic key 130 and the user rotating the cylinder plug 34 for actuation of the deadbolt mechanism. If the user does not rotate the cylinder plug 34 after insertion of an authorized electronic key 130, the system will time out and the plunger will return to its normally extended position to engage slot 114 and lock the mechanism accordingly.

In an alternative embodiment as shown in FIG. 9, the sidebar 110 is eliminated, and a solenoid 121 including a solenoid plunger 122 and bias spring 124 act directly in conjunction with the cylinder plug 34 to selectively lock rotation thereof. In this embodiment, the plunger 122 in its normally extended position will engage a slot 132 formed on the cylinder plug 34, whereby rotation of the cylinder plug 34 is prevented until actuation of the solenoid 121 and retraction of the plunger 122 by microprocessor control. Upon actuation of the solenoid 121, and retraction of the solenoid plunger 122, the cylinder plug 34 is able to rotate to thereby operate the deadbolt mechanism in the desired manner, and upon return of the cylinder plug to its home position, the plunger 122 will again engage the slot formed in the cylinder plug 34 to lock rotation thereof. Other operational features in this embodiment may be similar to that described with reference to the previous embodiment. In both embodiments of the invention, the axis of the solenoid plunger is transverse and offset with to respect to the lock cylinder rotational axis, thereby effectively inhibiting rotation of the cylinder plug 34 until retraction of the solenoid plunger in the desired manner.

The lock mechanism according to the present invention provides an electronically actuable mechanism which is simple in construction and yet effective to provide enhanced security in a variety of environments. The mechanism can be used to replace conventional locking mechanisms, such that no other preparation of a door or the like is necessary, and allows the user to simply reprogram the mechanism to allow only authorized electronic keys to be used therewith in the desired manner. No rekeying or replacement of the locking mechanism is required to maintain security of the mechanism, thereby avoiding cost or labor associated with such procedures. The lock mechanism has a limited number of parts, and is extremely reliable, and is cost-effective in its implementation.

Whereas the invention has been shown and described with reference to particular embodiments thereof, it should be realized that there may be many modifications, substitutions or alterations thereto which are encompassed within the scope of the invention. The embodiments of the invention in which an exclusive property or privilege is claimed are defined as follows.

What is claimed is:

1. An electronic lock assembly comprising, a lock cylinder defining a cylinder axis and a first slot portion extending axially along the lock cylinder, the lock cylinder being rotatably mounted in conjunction with a locking mechanism, the locking mechanism including a housing and a bolt, wherein selective rotation of the lock cylinder from a home position causes unlocking of the locking mechanism, the lock cylinder having a portion thereof which is engaged in the home position to selectively prevent rotation thereof, a solenoid assembly comprising a plunger which is normally biased to a first position, wherein the plunger in the first position prevents rotation of the lock cylinder, and wherein actuation of the solenoid assembly to move the plunger to a second position allows rotation of the lock cylinder, and an elongated rotation preventing member including a substantially flat major face extending substantially parallel to the cylinder axis, the plunger being operable to maintain the elongated rotation preventing member in linear engagement with the first slot portion so as to prevent rotation of the lock cylinder, the elongated rotation preventing member defining a second slot portion in the major face, the second slot portion being selectively engaged by the plunger to prevent movement of the rotation preventing member out of engagement with the first slot portion.

2. The lock assembly according to claim 1, wherein the lock cylinder comprises a cylinder plug including a keyway to accommodate an electronic key.

3. The lock assembly according to claim 1, wherein the first slot portion comprises an angled slot, and the elongated rotation preventing member includes a pointed edge contoured to engage the angled slot, wherein upon actuation of the solenoid assembly, rotation of the lock cylinder will cause the elongated rotation preventing member to be displaced from the angled slot.

4. The lock assembly according to claim 3, wherein the angled slot comprises first and second walls formed at a predetermined angle with respect to one another, and the pointed edge is contoured such that upon rotation of the lock cylinder, the pointed edge is urged outwardly of the angled slot.

5. The lock assembly according to claim 1, wherein the rotation preventing member is biased into the first slot portion by a spring member.

6. The lock assembly according to claim 2, wherein the lock cylinder comprises a pin assembly which is contacted by a contact pin of the electronic key upon insertion of the key into the keyway of the lock cylinder to selective actuate the solenoid assembly to cause movement of the plunger to the second position.

7. The lock assembly according to claim 6, wherein the pin assembly communicates a data from the electronic key to a microprocessor housed in the lock assembly.

8. The lock assembly according to claim 7, wherein data from the electronic key is determined to be from an authorized electronic key to cause actuation of the solenoid assembly.

9. The lock assembly according to claim 8, wherein the lock cylinder comprises an indicator at an external location to indicate if the authorized electronic key has been inserted into the lock cylinder.

10. The lock assembly according to claim 1, wherein the axis of the solenoid assembly is transverse to the rotational axis of the lock cylinder.

11. The lock assembly according to claim 10, further comprising an inside turn assembly to selectively operate the locking mechanism, wherein the inside turn assembly houses a power source and microprocessor for actuation and control of the solenoid assembly.

12. The lock assembly according to claim 1, wherein the solenoid assembly comprises a frame and solenoid bobbin into which the plunger is inserted.

13. The lock assembly according to claim 12, wherein the plunger is biased to the first position by a spring member in association with the bobbin.

14. The lock assembly according to claim 1, wherein the first position is an extended position and the second position is a retracted position.

15. A method of controlling operation of an electronic lock assembly with an authorized electronic key, the method comprising:

providing a lock cylinder defining a cylinder axis, the lock cylinder to be selectively rotatable by the authorized electronic key to unlock a locking mechanism associated with the lock assembly, the lock cylinder defining an elongated first slot portion extending axially along the lock cylinder, the lock cylinder including a housing and a bolt, providing an elongated rotation preventing member including a substantially flat major face extending substantially parallel to the cylinder axis, the elongated rotation preventing member defining a second slot portion in the major face, controlling operation of a solenoid assembly having a plunger which is normally biased into a first position in the second slot portion to prevent rotation of the lock cylinder, engaging the elongated rotation preventing member with the plunger, moving the elongated rotation preventing member into the elongated first slot portion, inserting the authorized electronic key, and actuating the solenoid assembly to move the plunger to a second position enabling rotation of the lock cylinder.

* * * * *